US010424425B2

(12) United States Patent
Hisamune

(10) Patent No.: US 10,424,425 B2
(45) Date of Patent: Sep. 24, 2019

(54) RESISTANCE SUBSTRATE AND RHEOSTAT COMPRISING SAME

(71) Applicant: PANASONIC INTELLECTUAL PROPERTY MANAGEMENT CO., LTD., Osaka (JP)

(72) Inventor: Hiroaki Hisamune, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/092,726

(22) PCT Filed: Apr. 20, 2017

(86) PCT No.: PCT/JP2017/015812

§ 371 (c)(1),
(2) Date: Oct. 10, 2018

(87) PCT Pub. No.: WO2017/188103

PCT Pub. Date: Nov. 2, 2017

(65) Prior Publication Data

US 2019/0122791 A1 Apr. 25, 2019

(30) Foreign Application Priority Data

Apr. 27, 2016 (JP) ..... 2016-089332

(51) Int. Cl.
*H01C 10/32* (2006.01)
*H01C 10/34* (2006.01)
*H01C 10/10* (2006.01)

(52) U.S. Cl.
CPC ..... *H01C 10/10* (2013.01); *H01C 10/32* (2013.01); *H01C 10/34* (2013.01)

(58) Field of Classification Search
CPC ..... H01C 10/10; H01C 10/30; H01C 10/32; H01C 10/34
See application file for complete search history.

(56) References Cited

U.S. PATENT DOCUMENTS 2,134,870 A * 11/1938 Fruth ..... H01C 10/00 338/142
2,632,831 A * 3/1953 Pritikin ..... H01C 10/48 29/620

(Continued)

FOREIGN PATENT DOCUMENTS

JP S63-098102 A 4/1988
JP H02-252203 A 10/1990

(Continued)

OTHER PUBLICATIONS

International Search Report and Written Opinion issued in International Patent Application No. PCT/JP2017/015812, dated Jul. 11, 2017; with partial English translation.

*Primary Examiner* — Kyung S Lee
(74) *Attorney, Agent, or Firm* — McDermott Will & Emery LLP

(57) ABSTRACT

A resistance substrate contains a substrate and a resistance part that is formed on an upper surface of the substrate by printing. The resistance part is formed into an arc shape (a C shape) so that a width of the resistance part continually changes. The resistance part is formed so that a part having a narrow width becomes thick and a part having a narrow width becomes thin.

9 Claims, 4 Drawing Sheets

(56) References Cited

U.S. PATENT DOCUMENTS

| | | | | | |
|---|---|---|---|---|---|
| 3,379,567 | A * | 4/1968 | Wright | H01C 10/04 | 338/138 |
| 3,723,938 | A * | 3/1973 | Gramm | H01C 10/04 | 338/162 |
| 3,921,118 | A * | 11/1975 | Ratzlaff | H01C 10/32 | 338/122 |
| 4,283,704 | A * | 8/1981 | Ohtani | H01C 10/22 | 338/138 |
| 9,035,209 | B2 * | 5/2015 | Tsuduki | H01H 19/10 | 200/564 |
| 2003/0160680 | A1 * | 8/2003 | Hisamune | H01C 10/32 | 338/162 |
| 2006/0040094 | A1 * | 2/2006 | Mizuno | B29C 45/1418 | 428/209 |

FOREIGN PATENT DOCUMENTS

| | | | |
|---|---|---|---|
| JP | 2004-335543 | A | 11/2004 |
| WO | 2010/079692 | A1 | 7/2010 |

* cited by examiner

RESISTANCE SUBSTRATE AND RHEOSTAT COMPRISING SAME

CROSS-REFERENCE OF RELATED APPLICATIONS

This application is the U.S. National Phase under 35 U.S.C. § 371 of International Patent Application No. PCT/JP2017/015812, filed on Apr. 20, 2017, which in turn claims the benefit of Japanese Application No. 2016-089332, filed on Apr. 27, 2016, the entire disclosures of which Applications are incorporated by reference herein.

TECHNICAL FIELD

The present invention relates to a resistance substrate and a rheostat for use in various electronic devices.

BACKGROUND ART

A known conventional rheostat includes a resistance substrate, a brush, and an operation body. The resistance substrate contains a resistance part that is formed in an arc shape and that is formed by printing. The brush is fixed to the operation body to make contact with the resistance part. Then, the operation body is rotated by, for example, a user.

According to the rheostat structured as described above, the brush is moved by rotating of the operation body to alter a contact point of the brush and the resistance part. The rheostat outputs resistance value according to a rotation angle of the brush (a position of the brush).

The resistance part of the resistance substrate is formed on an insulating substrate by a screen printing method. That is, the substrate is superimposed onto a lower surface of a mask including a permeation part that is formed in an arc shape, and paste-formed resistance material is squeezed on an upper surface of the mask to form the resistance part.

CITATION LIST

Patent Literature

PTL 1: Unexamined Japanese Patent Publication No. 2004-335543

SUMMARY OF THE INVENTION

However, in a case that the arc shaped resistance part is formed by a screen printing method, it is difficult to form the resistance part with an even thickness in a circumferential direction. Therefore, the resistance part of the conventional resistance substrate is hardly formed to have even surface resistivity in the circumferential direction.

Hence, according to the rheostat including the conventional resistance substrate, a relation between the rotation angle of the brush (the position of the brush) and the resistance value that is outputted, is easy to deviate from an ideal proportional relation. In other words, in the rheostat using the conventional resistance substrate, it is difficult for variation of the resistance value with respect to variation of a rotation angle of the operation body (a position of the operation body) to show excellent linearity.

On the other hand, a resistance substrate of the present invention includes a substrate and a resistance part formed in an arc shape on the substrate. The resistance part includes a first part and a second part that is narrower in width than the first part. The second part is formed to be thicker than the first part. A width of the resistance part is formed to continuously change between the first part and the second part.

According to the resistance substrate of the present invention, in the resistance part formed by printing resistance material, a width of a part that is easy to be thick is structured to be narrower than that of a part that is easy to be thin. Therefore, the resistance substrate of the present invention restrains variation of sectional area in the circumferential direction. A rheostat including the resistance substrate of the present invention improves linearity of output change.

DESCRIPTION OF EMBODIMENTS

Figure 1:
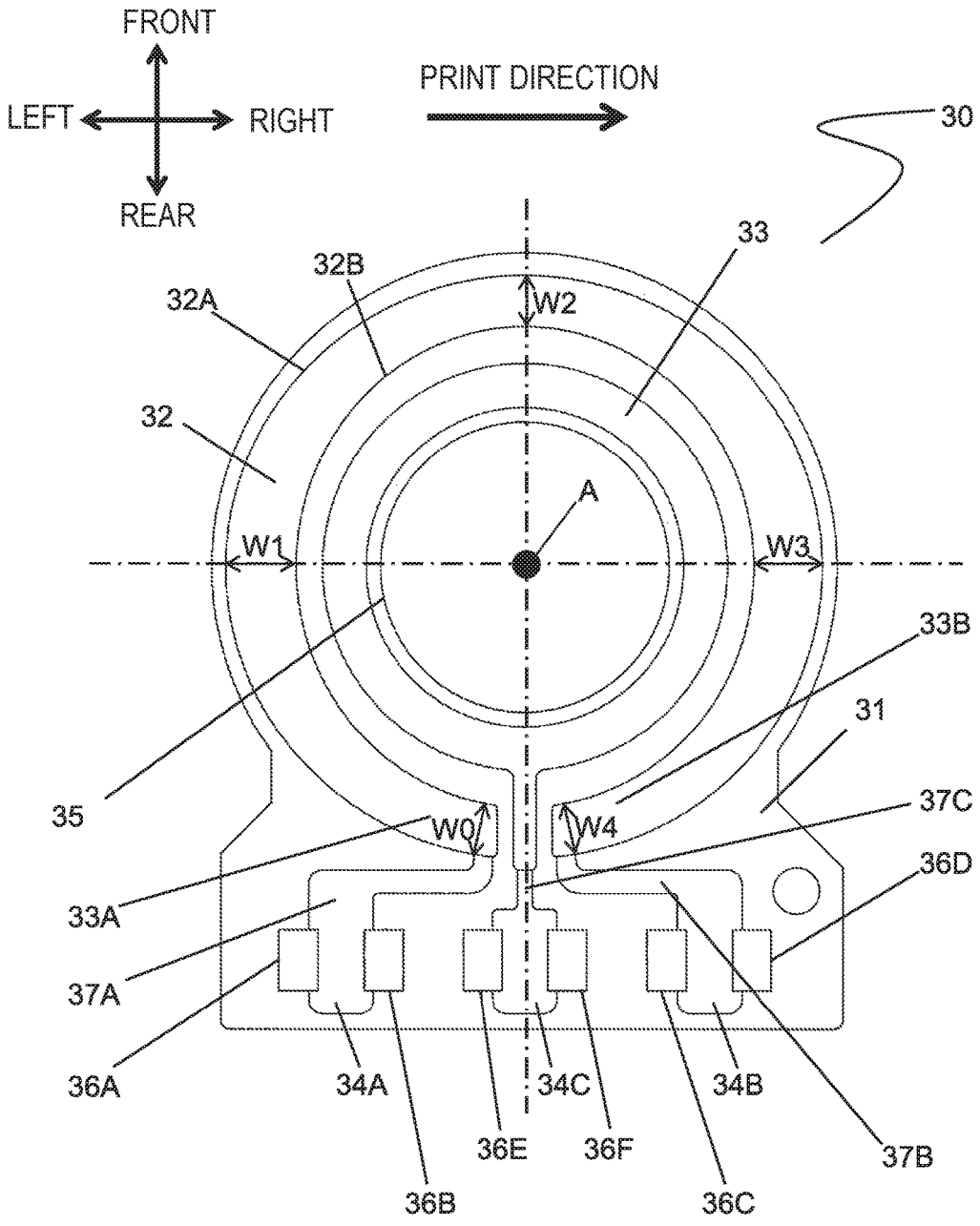
FIG. 1 is a plan view of a resistance substrate of an exemplary embodiment of the present invention.

An exemplary embodiment of the present invention will be described with reference to FIG. 1. FIG. 1 is a plan view of resistance substrate 30. FIG. 1 is a plan view of the resistance substrate of the exemplary embodiment of the present invention.

In order to easily describe, a side of substrate 31 on which resistance part 32 is formed is referred to as "up", and the opposite side of substrate 31 is referred to as "down". In other words, "up" and "down" indicate a position of resistance part 32 with respect to substrate 31 as a reference.

A side on which land zones 34A to 34C are provided is referred to as "rear", and the opposite side is referred to as "front". In other words, "up" and "down" indicate directions of resistance part 32 with respect to land zones 34A to 34C as a reference.

A side on which land zone 34A is provided with respect to land zone 34C as a reference is referred to as "left", a side on which land zone 34B is provided with respect to land zone 34C as a reference is referred to as "right". In other words, "left" and "right" indicate directions of land zone 34A and land zone 34C with respect to a position of land zone 34C as a reference.

An angle position means a position on resistance part 32 that is represented by a central angle formed with first end part 33A and the position on resistance part 32 with point A that is a center of through hole 35 as a center.

A circumferential direction is a direction along resistance part 32. In other words, the circumferential direction is the direction from first end part 33A to second end part 33B along resistance part 32. Namely, the circumferential direction is the direction along curve 32A and curve 32B.

A width of resistance part 32 is a dimension of a radial direction with the center of through hole 35 (point A) as a center on a predetermined angle position of resistance part 32. In other words, the width of resistance part 32 is a length of a segment that connects a predetermined position of curve 32B and curve 32A with the shortest distance.

An arrow illustrated in FIG. 1 shows a squeezing direction in a case that resistance part 32 is formed. That is, resistance part 32 shown in FIG. 1 is formed by squeezing paste-formed resistance material from left to right. The arrow illustrated in FIG. 1 is not intended to be used for restricting the squeezing direction but only shown in order that the exemplary embodiment is easily understood.

As shown in FIG. 1, resistance substrate 30 includes substrate 31 and resistance part 32. Substrate 31 is provided with circular through hole 35. Arc shape (a C shape) resistance part 32 to surround through hole 35 in a top view is formed by a screen printing method.

Resistance part 32 is formed into the arc shape (the C shape) whose opening portion faces in a rear direction in a top view. Therefore, resistance part 32 includes first end part 33A and second end part 33B. First end part 33A and second end part 33B are formed to be opposite to each other. First end part 33A and second end part 33B are electrically insulated between portions that are opposite to each other.

Resistance part 32 includes curve 32A and curve 32B. Curve 32A forms an outer edge of resistance part 32. Curve 32B forms an inner edge of resistance part 32. In other words, curve 32B is formed between curve 32A and an edge of through hole 35 on substrate 31.

Resistance part 32 is formed into the C shape so that the width continually changes in the circumferential direction from first end part 33A to second end part 33B. In other words, a distance between curve 32A and curve 32B continually changes along the circumferential direction on resistance part 32. Namely, the width continually changes between a first part on an angle position and a second part on a different angle from that of the first part. In other words, the width continually changes within a range of a predetermined angle position. That is, the width of resistance part 32 is not constant. The first part and the second part are positions determined by relative magnitude of the width. In FIG. 1, Position A is the first part with respect to Position B and Position B is the second part with respect to Position A, for example. In FIG. 1, Position A is the second part with respect to Position C and Position C is the first part with respect to Position A, for example.

Resistance part 32 is formed described above. That is, resistance part 32 is not a simple arc with the center of through hole 35 (point A) as the center.

Resistance part 32 is formed so that width W2 of a part that is opposite to the opening portion of the C shape through the center of through hole 35 (point A) is the narrowest. Resistance part 32 is formed so that at least one of width W1 of a part that is located at −90° with respect to the part of width W2 with point A as the center and width W3 of a part that is located at 90° with respect to the part of width W2 with point A as the center is the widest.

Incidentally, width W1 and width W3 are approximately equal. Both width W0 of first end part 33A and width W4 of second end part 33B are set to be narrower than width W1. Both width W0 of first end part 33A and width W4 of second end part 33B are set to be narrower than width W3.

Namely, the width of resistance part 32 gradually widens from first end part 33A (a part of width W0) to the part of width W1 and gradually narrows from the part of width W1 to the part of width W2. Further, the width of resistance part 32 gradually widens from the part of width W2 to the part of width W3 and gradually narrows from the part of width W3 to second end part 33B (a part of width W4).

First end part 33A and second end part 33B need not be formed to be opposite to each other. First end part 33A and second end part 33B only need to be electrically insulated each other. In FIG. 1, resistance part 32 is exaggeratedly illustrated in order that change of the width at a predetermined angle position is easily known.

Resistance part 32 is formed by the screen printing method as described. That is, a mask including a permeation part that is formed into an arc shape (a C shape) is arranged to be superimposed onto an upper surface of substrate 31, and paste-formed resistance material is squeezed on an upper surface of the mask to form the resistance part 32 on the upper surface of substrate 31.

A thickness of resistance part 32 formed by the screen printing method depends on permeability of the resistance material against the permeation part that is formed on the mask. That is, the higher permeability is, the thicker resistance part 32 becomes, and the lower permeability is, the thinner resistance part 32 becomes. Permeability changes according to a relation between an external shape of the permeation part of the mask that determines the shape of resistance part 32 and the squeezing direction.

In FIG. 1, on resistance part 32 for example, permeability tends to become high at a part on which a tangential line of one of curve 32A and curve 32B that compose an external shape of resistance part 32 approaches parallel to the squeezing direction (a left and right direction). On the other hand, permeability tends to become low at a part on which the tangential line of one of curve 32A and curve 32B that compose the external shape of resistance part 32 approaches perpendicular to the squeezing direction (the left and right direction).

Namely, the part of width W2 becomes thick and the parts of widths W1 and W3 become thin on resistance part 32. The thicknesses of the part of width W1 and the part of width W3 are approximately equal.

Resistance part 32 is set so that a part having a narrower width becomes thicker than another part having a wider width as described above. In other words, resistance part 32 is set so that a width dimension and a thickness dimension at a determined angle position become in inverse proportion to each other. Hence, resistance part 32 is formed such that the part of width W2 having the narrowest width becomes the thickest and at least one of the part of width W1 and the part of width W3 becomes the thinnest.

Therefore, resistance substrate 30 restrains variation of sectional area in the circumferential direction of resistance part 32. Accordingly, resistance substrate 30 has even surface resistivity in the circumferential direction of resistance part 32. Consequently, rheostat 100 (see FIG. 2) including resistance substrate 30 improves linearity of output change.

As described above, the squeezing direction of the exemplary embodiment conforms to the left and right direction. The squeezing direction may conform to a front and rear direction or an oblique direction, for example.

In a case that the squeezing direction conforms to the front and rear direction, for example, a tendency of the thickness of resistance part 32 is inverted with respect to that described above. Namely, in this case, the part of width W2 becomes thin and the parts of widths W1 and W3 become thick on resistance part 32. The thicknesses of the part of width W1 and the part of width W3 are approximately equal.

Therefore, the width dimension of resistance part 32 may be set to become an inverted structure (width W1≈width W3<width W2) with respect to that shown in FIG. 1. That is, resistance part 32 had better be set such that width W2 becomes the widest. At least one of width W1 and width W3 had better be set to become the narrowest. Width W1 and width W3 had better be set to become approximately equal.

Both width W0 of first end part 33A and width W4 of second end part 33B of resistance part 32 had better be set to be wider than width W1. Both width W0 and width W4 had better be set to be wider than width W3. The width dimension of resistance part 32 may be set according to the thickness of resistance part 32 determined by the squeezing direction as described above.

Figure 2:
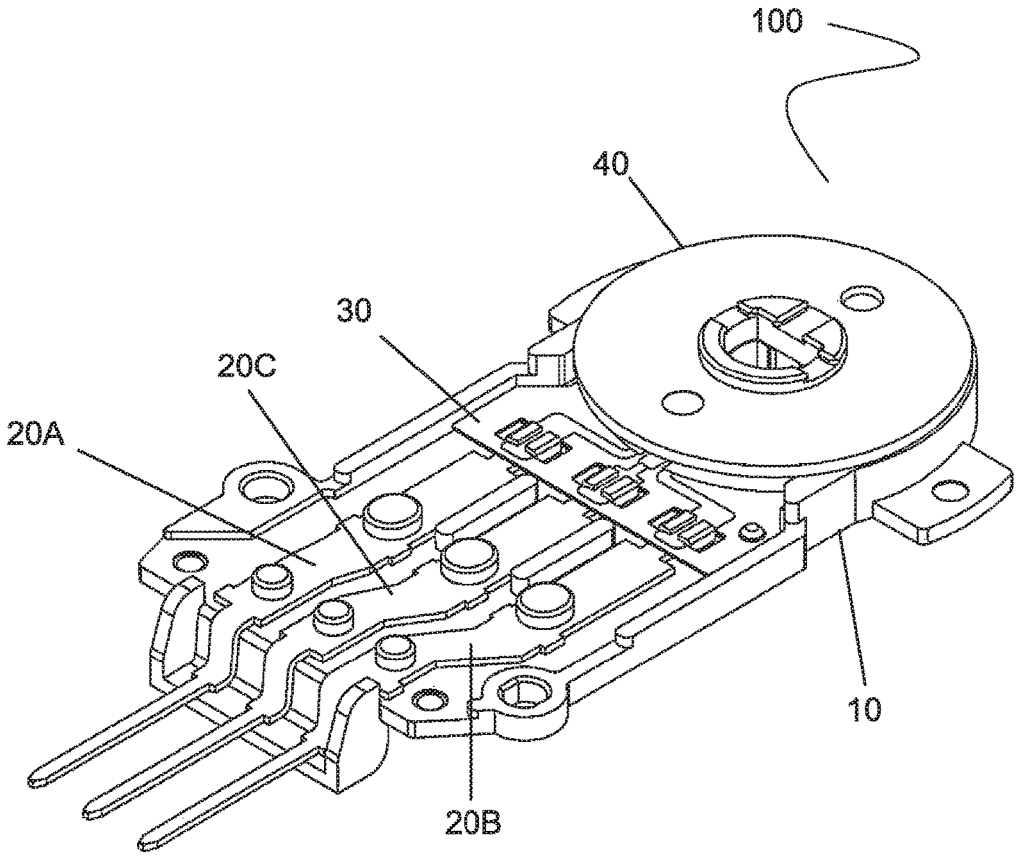
FIG. 2 is a perspective view of a rheostat including the resistance substrate illustrated in FIG. 1.
Figure 3:
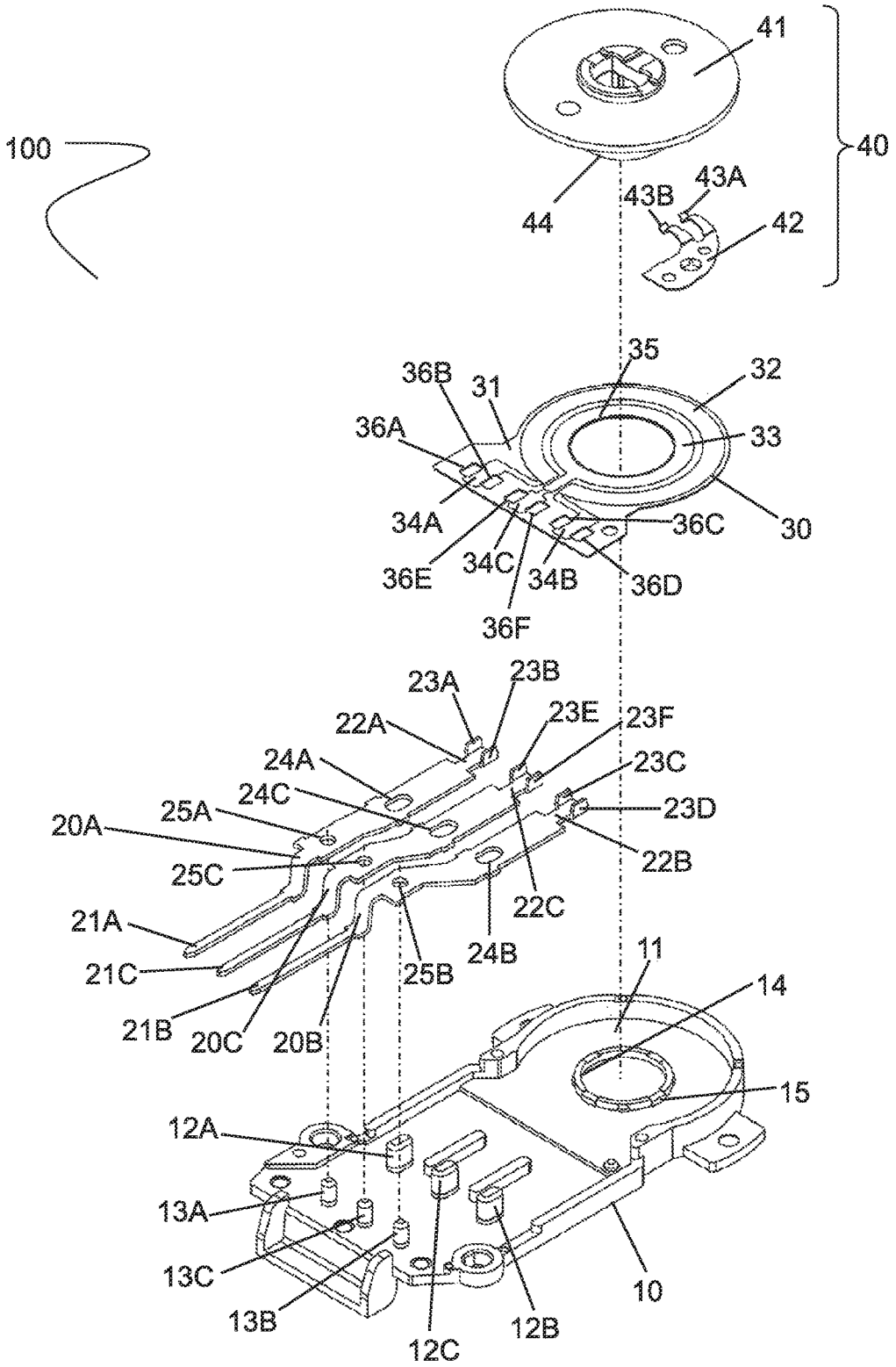
FIG. 3 is an exploded perspective view of the rheostat illustrated in FIG. 2.

With reference to FIGS. 1 to 3, a description of a more detail structure of resistance substrate 30 and rheostat 100 using resistance substrate 30 will be made hereinafter. FIG. 2 is a perspective view of rheostat 100 including resistance substrate 30 illustrated in FIG. 1. FIG. 3 is an exploded perspective view of rheostat 100 illustrated in FIG. 2.

Rheostat 100 includes resistance substrate 30, case 10, fixed electrodes 20A to 20C, and operation body 40 as illustrated in FIG. 2 and FIG. 3. As shown in FIG. 1, resistance substrate 30 further includes annular electrode part 33 and land zones 34A to 34C as well as substrate 31 and resistance part 32 described above.

An external shape of substrate 31 is a figure of Ω shape formed by joining a circular part and a rectangular part as shown in FIGS. 1, 3. Resistance part 32 and electrode part 33 are formed on the circular part that is disposed on the upper surface (a reverse surface of a surface that is opposite to case 10) of substrate 31. Land zones 34A to 34C each of which is a rectangular shape in a top view are formed on the rectangular part that is disposed on the upper surface of substrate 31.

Circular through hole 35 that penetrates through substrate 31 is provided on a center portion of the circular part of substrate 31 as described above. On the rectangular part of substrate 31, holes 36A to 36F, each of which is formed in a rectangular shape, are provided. Hole 36A and hole 36B are respectively provided on both ends of land zone 34A in a width direction of land zone 34A. Hole 36E and hole 36F are formed in rectangular shapes and respectively provided on both ends of land zone 34C in a width direction of land zone 34C.

Resistance part 32 is disposed approximately along an outer circumference of the circular part of substrate 31. First end part 33A is electrically connected to land zone 34A through leader line 37A. Second end part 33B is electrically connected to land zone 34B through leader line 37B. Resistance part 32 had better include high resistance material that contains carbon as a base compound.

Land zone 34A necessarily need not be connected to first end part 33A. Land zone 34A may be connected to a wider width part or a narrower width part than first end part 33A. In other words, land zone 34A only has to be electrically connected to resistance part between first end part 34A and the first part. Similarly, land zone 34B only has to be electrically connected to resistance part 32 at a portion nearer to second end part 33B than land zone 34A. Namely, land zone 34B necessarily need not be connected to first end part 33B. That is, land zone 34B may be connected to a wider width part or a narrower width part than second end part 33B.

Electrode part 33 is disposed inside resistance part 32 to be along through hole 35. Electrode part 33 is electrically connected to land zone 34C through leader line 37C passing through the opening portion of resistance part 32.

Figure 4:
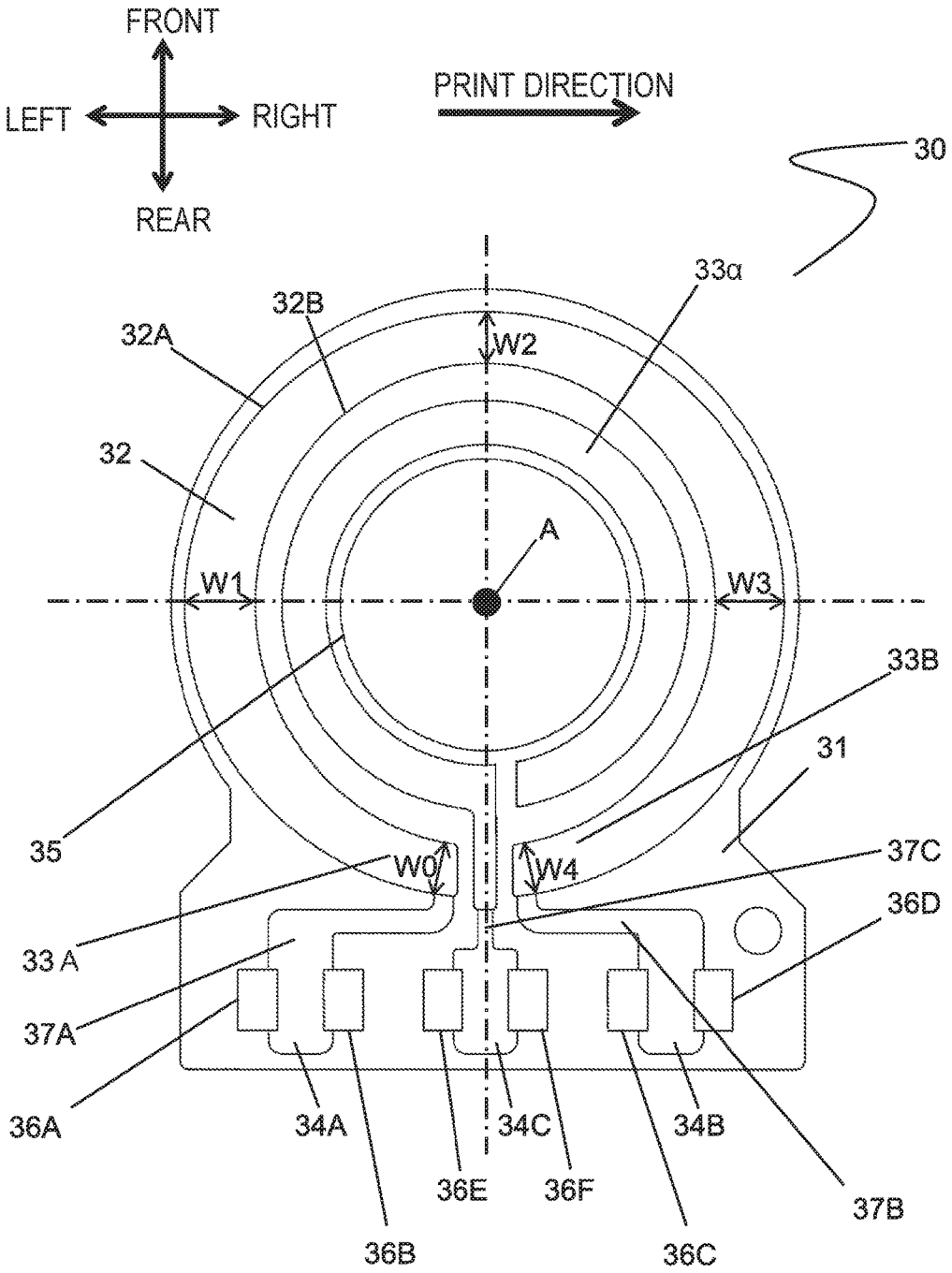
FIG. 4 is a modification of the resistance substrate illustrated in FIG. 1.

As shown in a modification of FIG. 4, arc shape electrode part 33*a* may be disposed instead of electrode part 33 illustrated in FIG. 1. Electrode part 33 and land zones 34A to 34C had better include low resistance material that contains silver as a base compound. Electrode part 33 and land zones 34A to 34C had better be formed by the screen printing method similarly to resistance part 32.

Case 10 is made of insulating resin material. Case 10 includes holder 11 for accommodating resistance substrate 30, and pillar parts 12A to 12C and pillar parts 13A to 13C for retaining fixed electrodes 20A to 20C.

On a center of holder 11, opening 14 circularly penetrating through holder 11, and wall part 15 formed to project upwardly from a periphery of opening 14 are provided. Wall part 15 is inserted into through hole 35 to retain resistance substrate 30 on holder 11.

Fixed electrodes 20A to 20C are formed by applying step-bending to an elongated metal plate as shown in FIG. 3. Fixed electrode 20A includes terminal part 21A that is disposed on a first end thereof and that protrudes from case 10 to an outside, and connection part 22A that is disposed on a second end thereof and that is connected to resistance substrate 30.

Since connection part 22A is step-bended, connection part 22A is positioned above terminal part 21A. Projection parts 23A, 23B projecting upwardly are respectively provided on both sides of connection part 22A.

On fixed electrode 20A, caulking hole 24A elliptically penetrating through fixed electrode 20A and caulking hole 25A circularly penetrating through fixed electrode 20A are provided. Caulking hole 24A is formed to be nearer to connection part 22A than caulking hole 25A.

Similarly, fixed electrode 20B includes terminal part 21B that is disposed on a first end thereof and that protrudes from case 10 to the outside, and connection part 22B that is disposed on a second end thereof and that is connected to resistance substrate 30. Since connection part 22B is step-bended, connection part 22B is positioned above terminal part 21B. Projection parts 23C, 23D projecting upwardly are respectively provided on both sides of connection part 22B. On fixed electrode 20B, caulking hole 24B elliptically penetrating through fixed electrode 20B and caulking hole 25B circularly penetrating through fixed electrode 20B are provided. Caulking hole 24B is formed to be nearer to connection part 22B than caulking hole 25B.

Fixed electrode 20C includes terminal part 21C that is disposed on a first end thereof and that protrudes from case 10 to the outside, and connection part 22C that is disposed on a second end thereof and that is connected to resistance substrate 30. Since connection part 22C is step-bended, connection part 22C is positioned above terminal part 21C. Projection parts 23E, 23F projecting upwardly are respectively provided on both sides of connection part 22C. On fixed electrode 20C, caulking hole 24C elliptically penetrating through fixed electrode 20C and caulking hole 25C circularly penetrating through fixed electrode 20C are provided. Caulking hole 24C is formed to be nearer to connection part 22C than caulking hole 25C.

Each of fixed electrodes 20A to 20C is fixed to case 10. Pillar part 12A is inserted into caulking hole 24A and pillar part 13A is inserted into caulking hole 25A, so that fixed electrode 20A is fixed to case 10 by caulking.

Similarly, pillar part 12B is inserted into caulking hole 24B and pillar part 13B is inserted into caulking hole 25B, so that fixed electrode 20B is fixed to case 10 by caulking. Similarly, pillar part 12C is inserted into caulking hole 24C and pillar part 13C is inserted into caulking hole 25C, so that fixed electrode 20C is fixed to case 10 by caulking.

Fixed electrodes 20A to 20B described above are respectively connected to land zones 34A to 34C of resistance substrate 30.

Projection parts 23A, 23B of connection part 22A are respectively inserted into holes 36A, 36B of resistance substrate 30 and projection parts 23A, 23B are caulked, so that fixed electrode 20A is electrically connected to land zone 34A. Similarly, projection parts 23C, 23D are respectively inserted into holes 36C, 36D of resistance substrate 30 and projection parts 23C, 23D are caulked, so that fixed electrode 20B is electrically connected to land zone 34B. Similarly, projection parts 23E, 23F are respectively inserted into holes 36E, 36F of resistance substrate 30 and projection parts 23E, 23F are caulked, so that fixed electrode 20C is electrically connected to land zone 34B.

Operation body 40 includes rotation body 41 and brush 42 held by rotation body 41. Rotation body 41 is an insulating resin member that is formed into a circular shape. On a center of a lower surface of rotation body 41, column part 44 that protrudes downwardly in a cylindrical shape is formed. Column part 44 is inserted through opening 14 of case 10, so that rotation body 41 is rotatably held by case 10.

Brush 42 is formed of elastic metal material. Tip portion of brush 42 branches into two to form contact parts 43A, 43B. Contact part 43A makes contact with an upper surface of resistance part 32 of resistance substrate 30 and contact part 43B makes contact with an upper surface of electrode part 33 of resistance substrate 30. Since brush 42 is fixed to the lower surface of rotation body 41, contact part 43A of brush 42 slides along the upper surface of resistance part 32 of resistance substrate 30 by rotating operation body 40. Similarly, contact part 43B of brush 42 slides along the upper surface of electrode part 33 of resistance substrate 30 by rotating operation body 40.

Rheostat 100 is configured as described above. An operation of rheostat 100 will be briefly described hereinafter.

On rheostat 100, for example, when rotation body 41 of operation body 40 is rotated by an operator or the like, brush 42 moves to rotate according to a rotation of rotation body 41. Land zone 34A is electrically connected to land zone 34C through resistance part 32, brush 42, and electrode part 33 in rheostat 100. Therefore, resistance value according to a contact angle position of resistance part 32 and contact part 43A is generated between land zone 34A and land zone 34C. Similarly, resistance value according to the contact angle position of resistance part 32 and contact part 43A is generated between land zone 34B and land zone 34C.

When rotation body 41 is rotated with a predetermined angle, a contact point of brush 42 and resistance part 32 moves according to a rotation angle of rotation body 41. Hence, in rheostat 100, the resistance value between land zone 34A and land zone 34C and the resistance value between land zone 34B and land zone 34C vary according to movement of the contact point of brush 42 and resistance part 32.

Electronic circuit not shown to which rheostat 100 is attached detects the resistance value, so that an electronic device on which rheostat 100 is installed is controlled according to a rotation angle position of rotation body 41.

In resistance part 32 of resistance substrate 30, a width of a part on which the thickness of resistance part 32 tends to be thin is set to be wide, and a width of a part on which the thickness of resistance part 32 tends to be thick is set to be narrow as described above.

Therefore, even though resistance part 32 is formed by printing with squeezing, variation of sectional area of resistance part 32 is restrained. Consequently, in rheostat 100 composed of resistance substrate 30, a relation between the rotation angle position of rotation body 41 and the resistance value outputted according to the rotation angle position becomes close to an ideal proportional relation. That is, in rheostat 100, an output change with respect to a change of the rotation angle position of operation body 40 shows excellent linearity.

INDUSTRIAL APPLICABILITY

A resistance substrate of the present invention is useful for a rotary operation type electronic device, for example a rheostat, since the resistance substrate restrains variation of sectional area.

REFERENCE MARKS IN THE DRAWINGS

10: case
11: holder
12A, 12B, 12C, 13A, 13B, 13C: pillar part
14: opening
15: wall part
20A, 20B, 20C: fixed electrode
21A, 21B, 21C: terminal part
22A, 22B, 22C: connection part
23A, 23B, 23C, 23D, 23E, 23F: projection part
24A, 24B, 24C, 25A, 25B, 25C: caulking hole
30: resistance substrate
31: substrate
32: resistance part
32A, 32B: curve
33: electrode part
33A: first end part
33B: second end part
34A, 34B, 34C: land zone
35: through hole
36A, 36B, 36C, 36D, 36E, 36F: hole
40: operation body
41: rotation body
42: brush
43A, 43B: contact part
44: column part
100: rheostat

The invention claimed is:

1. A resistance substrate comprising:
a substrate; and
a resistance part that is formed in an arc shape on the substrate, wherein:
the resistance part includes:
a first part:
a second part that is narrower in width than the first part, wherein the second part is thicker than the first part; and
a third part that is narrower in width than the first part, wherein the third part is thicker than the first part,
the first part, the second part and the third part are positioned in the order of the second part, the first part and the third part, and
a width of the resistance part continuously increases from the second part to the first part, and continuously decreases from the first part to the third part.

2. The resistance substrate according to claim 1, wherein:
the resistance part further includes a first end part and a second end part,
the first part, the second part and the third part are positioned between the first end part and the second end part, and
the width of the resistance part continuously changes between the first end part and the second end part.

3. The resistance substrate according to claim 2, wherein the first part is a widest part.

4. The resistance substrate according to claim 2, further comprising a first land zone that is electrically connected to the resistance part.

5. The resistance substrate according to claim 4, wherein the first land zone is electrically connected to the resistance part between the first end part and the first part.

6. The resistance substrate according to claim 4, wherein the first land zone is electrically connected to the first end part.

7. The resistance substrate according to claim 4, further comprising:

an electrode part formed inside the resistance part, the electrode part an arc or annular shape, and a second land zone that is electrically connected to the electrode part.

8. The resistance substrate according to claim 7, further comprising a third land zone that is connected to the resistance part at a nearer portion to the second end part than the first land zone is.

9. A rheostat comprising:

the resistance substrate according to claim 1; and a brush that moves in an arc shape with the brush making contact with the resistance part, wherein the resistance substrate includes a first land zone that is electrically connected to the resistance part, an electrode part that is formed inside the resistance part, the electrode part having an arc or annular shape and a second land zone that is electrically connected to the electrode part, the brush is electrically connected to the electrode part.

* * * * *